United States Patent [19]

Schulz

[11] Patent Number: 4,789,476

[45] Date of Patent: Dec. 6, 1988

[54] CYCLONE SEPARATOR WITH TWO SEPARATING ZONES AND STATIC GUIDE MECHANISMS

[76] Inventor: Siegbert Schulz, Kirchweg 27, D-3101 Lachendorf, Fed. Rep. of Germany

[21] Appl. No.: 3,381

[22] PCT Filed: Mar. 19, 1986

[86] PCT No.: PCT/DE86/00119

§ 371 Date: Mar. 6, 1987

§ 102(e) Date: Mar. 6, 1987

[87] PCT Pub. No.: WO86/05417

PCT Pub. Date: Sep. 25, 1986

[30] Foreign Application Priority Data

Mar. 19, 1985 [DE] Fed. Rep. of Germany ..... 3509789
Mar. 4, 1986 [DE] Fed. Rep. of Germany ..... 3607023

[51] Int. Cl.[4] ..... E01D 17/038

[52] U.S. Cl. ..... 210/512.1; 209/144; 209/211

[58] Field of Search ..... 210/512.1, 304; 209/144, 211; 55/406–409, 447, 455, 459 R, 459 A, 459 B, 459 C, 459 D

[56] References Cited

U.S. PATENT DOCUMENTS 2,604,956 7/1952 Israel ..... 183/83
2,719,631 10/1955 Vicard ..... 210/51
2,967,618 1/1961 Vane ..... 210/512.1

FOREIGN PATENT DOCUMENTS 626382 2/1935 Fed. Rep. of Germany .
3223374 6/1982 Fed. Rep. of Germany .
810851 8/1936 France .
1134443 6/1955 France .
1350838 11/1962 France .
956028 12/1980 U.S.S.R. .

OTHER PUBLICATIONS

Staub-Reinhaltung der Luft, vol. 45, No. 4, Apr. 1985, Düsseldorf, DE, P. Schmidt: "Zyklonabscheider mit schraubenspalt Diffusor", pp. 163–165.

*Primary Examiner*—Frank Sever
*Attorney, Agent, or Firm*—Price, Gess & Ubell

[57] ABSTRACT

Cyclone separator with two separating zones and static guide mechanisms. As a result of an immersion tube column (5, 6, 7), which surrounds the cyclone axis (1) over the entire separating zone height h, which is arranged in the vortex core of the conventional cyclone and passes through the conventional solids collecting container (2a), both the outer swirling flow in the outer separator zone (3a) and also an inner swirling flow concentrated in the immersion tube column in the second separating zone (3b) is stabilized in combination with a return flow-free solids discharge device (4), so that in the case of an intense swirl a following separating process takes place with axial return flows (18) from swirl promoter (17) into a second solids collecting container (2b). The components of the immersion tube column are the conventional immersion tube (5), a downwardly located slotted slit immersion tube (6) in the axial extension thereof and a downwardly following central immersion tube (7), to which is flanged the second solids collecting container (2b). The sucking slit immersion tube (6) is used as the inflow guide mechanism for the swirl promoter (17) and has four parallel-wall, curved intake channels (10) uniformly distributed about the immersion tube circumference with in each case a straight leading edge (9), which exert an accelerating action on the flow. The recovery of the kinetic energy of the swirling flow is brought about by an outflow spiral (8) above the cyclone cover (13).

8 Claims, 10 Drawing Sheets

CYCLONE SEPARATOR WITH TWO SEPARATING ZONES AND STATIC GUIDE MECHANISMS

Figure 1:
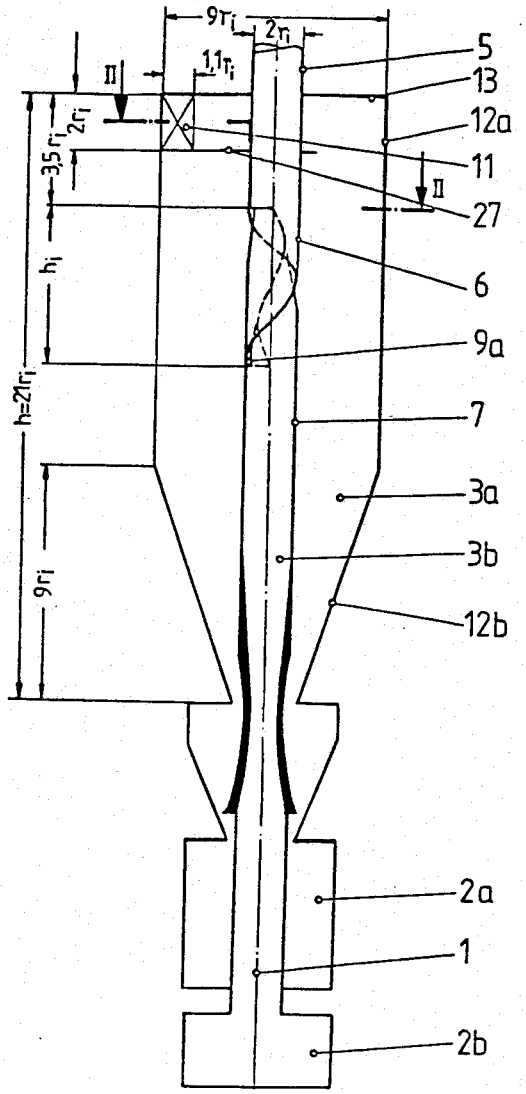

The invention relates to a cyclone separator with two separating zones and static guide mechanisms for improving the separating capacity with respect to very finely dispersed particles from flowing gases and for reducing the pressure drop or for influencing the field of flow of a conventional centrifugal force separator with a tangential, spiral or helical intake channel, with a cyclone casing which is cylindrical at the top and conical at the bottom, as well as a solids collecting container positioned below it, a cylindrical immersion tube for removing the pure gas flow projecting centrally from above into the cyclone casing within the cylindrical separating zone.

In a centrifugal force separator, the inflowing feed is separated as a result of the centrifugal forces occurring in a swirling flow, which act on the particles flowing in circular or spiral paths. As a result of the axial velocity component of the field of flow, the separated coarse material slides in spiral manner on the cyclone outer wall into the solids collecting container, which forms the lower termination of the cyclone casing. The unseparated fine material passes with the gas flow flowing out through the immersion tube into the clean gas channel.

The simple operation of a conventional centrifugal force separator ensures, as is known, a high operating reliability, low maintenance expenditure, low prime costs and limited space requirements. The limits of its wide use range are at an operating pressure of 100 bar and gas temperatures of over 1000° C.

However, the use advantages of a conventional cyclone must be considered against the disadvantages of the high pressure drop and low separating capacity with respect to the separation efficiency compared with other separators. Known conventional cyclones have as the main cause of the low separating capacity an irregular, axial velocity distribution along the interface, secondary flows, short-circuit flows and strong turbulence within the separating zone. The main cause of the high pressure drop is the non-conversion of the energy of rotation necessary for separation into pressure energy, due to deflection losses and a restricting action at the immersion tube inlet, so that up to 90% of the total pressure drop occurs in the vortex core (cyclone eye) below the immersion tube.

As a result of the requirement of limiting emissions of dust which can enter the lungs, the recovery of valuable products or the maximum separation of abrasion dust from process gases, as well as for energy reasons, the conventional cyclone must be increasingly combined with other separating means, which are more efficient in finely dispersed particle size ranges below 20 μm. These requirements and the fact that the cyclone is the only industrially usable separator for removing dust from hot gases at above 500° C., require additional constructional measures for improving the separating capacity and for reducing the pressure drop.

For fulfilling these requirements, it is known to install guide mechanisms in the separating zone or within the immersion tube, but the hitherto published patent applications do not take account of all the causes of the low separating capacity and the high pressure drop and no new cyclone development provides a second separating zone constructionally within a single apparatus and additionally makes use of return flows around the cyclone axis for particle separation purposes.

In a known cyclone construction (DE-OS No. 23 61 995), the conventional, cylindrical immersion tube, apart from its axial opening, is provided on the lower end face with additional slotted gas inlets within the immersion tube jacket, which are formed by pressed in cover plates of said jacket. The dust removal efficiency cannot be improved, because said slotted immersion tube construction suffers from the important disadvantage that neither the strong sink flow below the immersion tube, nor the solids layer flow along the outer immersion tube circumferential surface can be reduced and no devices are provided for a following solids separation. Devices for recovering the kinetic energy are also not provided.

A further cyclone with a slotted immersion tube is known (EP-OS No. 0 041 106), which admittedly utilizes the effect of a double separation with a single apparatus, but without collecting within a second separating zone the solids separated within the immersion tube. A conventional, slotted immersion tube with an axial outflow slit permits due to the suction action from the ambient as a result of a slit, located between the inflow channel and immersion tube, the return of already discharged fines which have built up on the inner immersion tube wall into the cyclone separating zone. Further disadvantages of this cyclone construction are the still remaining, axially non-uniformly distributed sink flow below the immersion tube and the suction of ambient air into the separation process, so that the pressure drop is increased.

In addition, slotted immersion tubes are described in the journals Chem.-Techn., 22, 1970, No. 9, pp. 525–532 and Maschinenbautechnik 7, 1958, No. 8, pp. 416–421. These immersion tube constructions are merely longitudinal slits arranged uniformly around the immersion tube circumference and are not edgewise slit channels, which bring about a flow deflection or an energy recovery.

Prof. Schmidt has provided a slotted slit immersion tube (Staub-Reinhaltung der Luft, 45, 1985, no. 4, pp. 163–165 and DE-OS No. 32 23 374), which has a helical entrance slit and a three-dimensional diffuser channel with deflection characteristics. This so-called helical diffuser is closed on the bottom face by a baseplate and is arranged below a conventional immersion tube. This slotted immersion tube reduces the pressure drop of a cylone separator by up to 50% and improves the separating capacity of a cyclone, because there is a transition from the circular hole sink flow to the linear sink flow. However, as the sole constructional measure, this newly developed immersion tube is not able to prevent the short-circuit and secondary flows and does not make it possible to remove the secondary solids separated within the immersion tube. As a result of the diffuser channel incorporated into the immersion tube, it is not possible to obtain a critical swirling flow with return flows.

The problem of the present invention, whilst avoiding the described deficiencies of conventional cyclones in general and the deficiencies of known, improved cyclone constructions with double separation and improved suction conditions in particular, is to provide a cyclone separator of the aforementioned type which is so constructionally developed that in the case of simple basic construction and additional components constituted by static, i.e., non-rotary guide and separating mechanisms, is characterized by a greatly improved overall and fraction separation efficiency, so that the separating efficiency of the cyclone separator is greatly improved, so that there is additionally a reduction in the pressure loss compared with the conventional construction.

According to the invention this problem is solved in that an immersion tube column, comprising the series connection of a conventional immersion tube, a slotted slit immersion tube with a helical or straight slit channel and a central immersion tube, which surrounds the cyclone axis over the entire height of the separating zone, is located in the cylindrical interface of the conventional cyclone separator, passes through the conventional solids collecting container and is connected in gastight manner to a second solids collecting container below the first container, each of the three partial immersion tubes being open at the top and bottom ends and the slit immersion tube is the sole sucking immersion tube.

Thus, it is proposed to place the immersion tube column as a second cyclone within the actual cyclone, so that in this way a two-stage separation is brought about in a single dust removal apparatus. However, unlike in the external separation process, the mass exchange takes place within the swirl promoter by energy transfer via the vortex core around the cyclone axis and return flows bring about the solids transfer into the secondary solids collecting container below the central immersion tube, if there is a supercritical swirling flow within the swirl promoter.

It must be borne in mind in connection with the inventive development of the cyclone separator, that the downwardly directed axial flow on the outer cyclone jacket in the outer field of flow of the swirling flow brings about the good discharge behaviour of the solid combined with the interface flow on the conical wall. In order to bring about an axial velocity component, the slit immersion tube must be arranged within the cyclone intake channel.

The slotted slit immersion tube is centrally installed in the cylindrical and not in the conical part of the cyclone casing between the conventional immersion tube and the central immersion tube, in order to reduce secondary flows from the separating wall of the cyclone jacket. The slit immersion tube permits the transition from the hole sink otherwise located below a conventional immersion tube with a non-uniform axial distribution of the radial velocity to the linear sink with an equalized, axial distribution of the radial velocity on the interface. The invention is based on the finding that through a slit channel with a helical leading edge or through several helically arranged slit channels with a straight leading edge within the slit immersion tube, the vortex sink flow in the outer separating zone is not disturbed or the flow turbulences in the separating zone are reduced and the volume flow of the gas is sucked at high speed over a curved intake channel adapted to the flow lines with an accelerating action on the flow in axially uniform manner over the leading edge out of the outer separating zone, so that there is an equalized velocity profile along the suction slit and the dust particles still present in the gas flow are concentrated in the wake core about the cyclone axis as a result of the compressive forces and are removed with the aid of return flows into the secondary solids collecting container, so that the separated coarse material proportion of the feed increases, which corresponds to an improvement of the overall and fraction separation efficiency.

For stabilizing the two-stage separating process, the immersion tube column is so arranged around the cyclone axis in the vortex core of the conventional cyclone, that is passes through the outer cylindrical and conical separating zone, the cylindrical shielding container and the primary solids collecting container.

Preferably a baffle is installed in the outer separating zone between the intake channel and the slit immersion tube below the cyclone intake channel in the horizontal plane parallel to the cyclone cover in such a way that short-circuit flows of the swirling flow are directly prevented in the suction slit channel of the slit immersion tube and the axial velocity component of the swirling flow is positively influenced in the outer separating zone with respect to the solid discharge behaviour. Thus, a breaking away of the cyclone intake flow on the leading edge of the cylindrical cyclone jacket is prevented, so that simultaneously the starting positions of the particles suspended in the entering gas flow is more clearly defined. Thus, the baffle permits a more uniform inflow into the slit channel of the slit immersion tube.

The slit immersion tube connected in the immersion tube column between the conventional immersion tube and the central immersion tube, can be provided with parallel-wall intake channels with in each case a straight leading edge uniformly distributed around the immersion tube circumference, so that the common diagonal of the four recess faces displaced by 90% forms a single helical line about the slit immersion tube and the particular curved slit channel in the slit immersion tube is provided as an intake channel with an accelerating flow action for a swirl promoter symmetrical to the cyclone axis, so that within the swirl promoter is formed a wake region with axial return flows into the central immersion tube in the case of a correspondingly high swirling intensity, which is fixed by the geometrical design of the slit channel and the slit immersion tube. High vacuum values on the cyclone axis and strong pressure changes in the axial direction induce the intense return flow into the central immersion tube and subsequently into the secondary solids collecting container.

The advantages obtained as a result of the invention are in particular that through the immersion tube column fixing the interface between the vortex field and the vortex core or through said guide and separating mechanisms the rigid body vortex (cyclone eye) of the conventional cyclone separator is concentrated further inwards about the cyclone axis or swirl promoter axis. This rigid body vortex fills up a secondary vortex or swirling field around it and this is the prerequisite for maintaining the secondary separating process within the swirl promoter.

The slotted slit immersion tube brings about, as a guide mechanism, a reinforcement of the vortex or swirling action produced in the cyclone intake in the centre of the swirl promoter. This inner swirling flow around the swirl promoter axis leads to a wake core about the swirl promoter axis, whose radius R increases with increasing swirling action and the particles are "trapped" therein. $R_0$ consequently indicates the limit between loss-free healthy flow in the range $R_0<r<R$ and lossy core flow in the range $R_0>r>O$. There is a strong vacuum in the wake zone, so that the particles are transferred in the compressive force direction to the cyclone axis and do not flow in the centrifugal force direction towards the swirl promoter wall, as is the case in the outer separating zone. A high $R_0$ favours the secondary separation effect, because on producing a critical swirling flow, there is no axially upwardly driving through flow within the wake core which would entrain the particles and instead there is a negative through flow around the cyclone axis, particularly within the slit immersion tube.

In the second solids collecting container, which is flanged to the central immersion tube and arranged below the first solids collecting container, collects the additionally separated solids, transported downwards via the central immersion tube with the aid of return flows so as to constitute additional coarse material and which in the case of a conventional cyclone construction would have flowed out via the conventional immersion tube in the form of fines. As a result of the immersion tube column surrounding the swirl promoter, additionally the three-dimensional, turbulent field of flow in the outer separating zone is stabilized, so that the cyclone axis is identical with the centre of the outer swirling flow. The centre of the inner swirling flow forms the swirl promoter axis congruent with the cyclone axis and which only in the case of a symmetrical inflow from the slit immersion tube would coincide with the cyclone axis.

In another construction according to the invention for increasing the rotational symmetry and the swirl intensity, the slit immersion tube with four intake channels helically distributed around the immersion tube circumference can be replaced by a slit immersion tube, which is either provided with several uniformly distributed slit channels arranged at the same axial height around the immersion tube circumference and having straight leading edges, or by a slit immersion tube with parallel-wall, helical slit channel, which has a helical leading edge and a helical trailing edge, which once again produces a supercritical swirl intensity with return flows into the central immersion tube if the particular slit channel is constructed as a curved deflecting channel with an accelerating action and the particular slit channel is provided with an upper and a lower coverplate, so that the suction from the outer separating zone takes place exclusively by means of a helical slit channel or by means of several slit channels uniformly distributed in edgewise manner around the immersion tube circumference.

The curved slit channels within the slit immersion tube serve as intake channels for the swirl promoter arranged symmetrically to the cyclone axis within the immersion tube column and the swirl promoter is preferably constructed as a flow-favourable intake guide mechanism for an outflow spiral casing with recess core arranged above the cyclone cover. The kinetic energy of the outer swirling flow and the inner swirling flow in the same direction can be recovered by a wide outflow spiral constructed in known manner and whose outlet connection issues into the clean gas channel and whose central wake zone can be filled within a widened conventional immersion tube by a corresponding recess core. Advantageously the intake of the parallel-wall slit channel is constructed as a slotted opening within the slit immersion tube jacket in such a way that in the intake zone of the slit channel the necessary flow velocity is obtained on the interface in accordance with the rotary sink flow, which is in turn taken in flow-favourable manner on the interface as a result of the configuration of the slit immersion tube circumference as a logarithmic spiral, so that the curved flow lines of the gas flow entering the swirl promoter through the slit channel pass along the outer and inner slit channel contours and in the same direction as the cyclone intake flow.

According to a further development of the invention a cylindrical shielding container is so interposed between the conical part of the outer separating zone and the conventional solids collecting container that the outer swirling flow passes out on an outer portion of the central immersion tube constructed as a shielding cone within the primary solids collecting container, so that the separated solids can pass in troublefree manner without any entraining effects in the annular clearance between the cylindrical shielding container and the central immersion tube into the primary solids collecting container and the solids cannot be vortexed again into the outer separating chamber through the provision of a conical deflector shield below the cylindrical shielding container and around the shielding cone.

The central immersion tube also permits a pressure-side separation of the swirling flow in the outer separating zone from the slightly circulating flow in the first solids collecting container, in that the shielding cone is arranged within the solids collecting container in such a way that a penetration of the separated solids into the separating zone is prevented and simultaneously the penetration of the separated solids through an annular discharge opening between cylindrical shielding container and central immersion tube is ensured. The inventive discharge mechanism consequently prevents both a whirling up again and also an entrainment of already separated particles.

According to a further development of the invention, the new development of the solids discharge mechanism ensures that the undesired solids transfer of already separated particles from the first dust collecting container into the conical outer separating zone is completely prevented and that the particles sliding spirally downwards on the conical circumferential surface of the outer separating zone are transported in troublefree manner into the first solids collecting container, without passing through turbulent flow zones with return flows, which would lead to whirling up again.

As will be shown hereinafter by means of graphs, the inventive construction of the cyclone separator leads to an increase in the overall separation efficiency and the fraction separation efficiency, whilst simultaneously reducing the pressure drop compared with conventional cyclone construction. In particular, the diameter of the smallest particles, which are 99% separated, is moved towards the 5 $\mu$m limit, which corresponds to a separation efficiency of the inventive cyclone, which could not hitherto be achieved in practice by cyclone separators. The average diameter of the particles which are 50% separated is 1 $\mu$m.

In order to improve the cyclone operating quantities, namely the overall separation efficiency, the fraction separation efficiency and pressure drop according to the invention it is not absolutely necessary to have a spiral cyclone intake channel in accordance with the described embodiment and it is also in fact possible to use a tangential or helical intake channel for the cyclone.

Further advantages, features and use possibilities of the invention can be gathered from the following description of preferred embodiments in conjunction with the drawings, wherein show:

FIG. 1: A diagrammatic longitudinal section through a cyclone embodiment with the inventive immersion tube column, the slit immersion tube having a helical leading edge and a diffuser-type slit channel.

Figure 2:
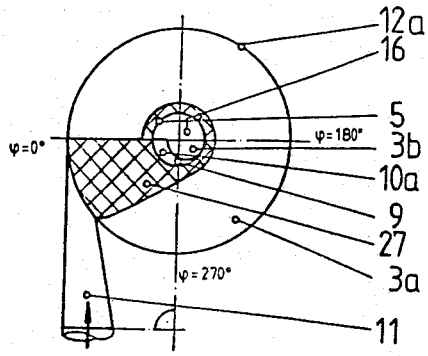

FIG. 2: A diagrammatic cross-section along section line II—II of FIG. 1.

Figure 3:
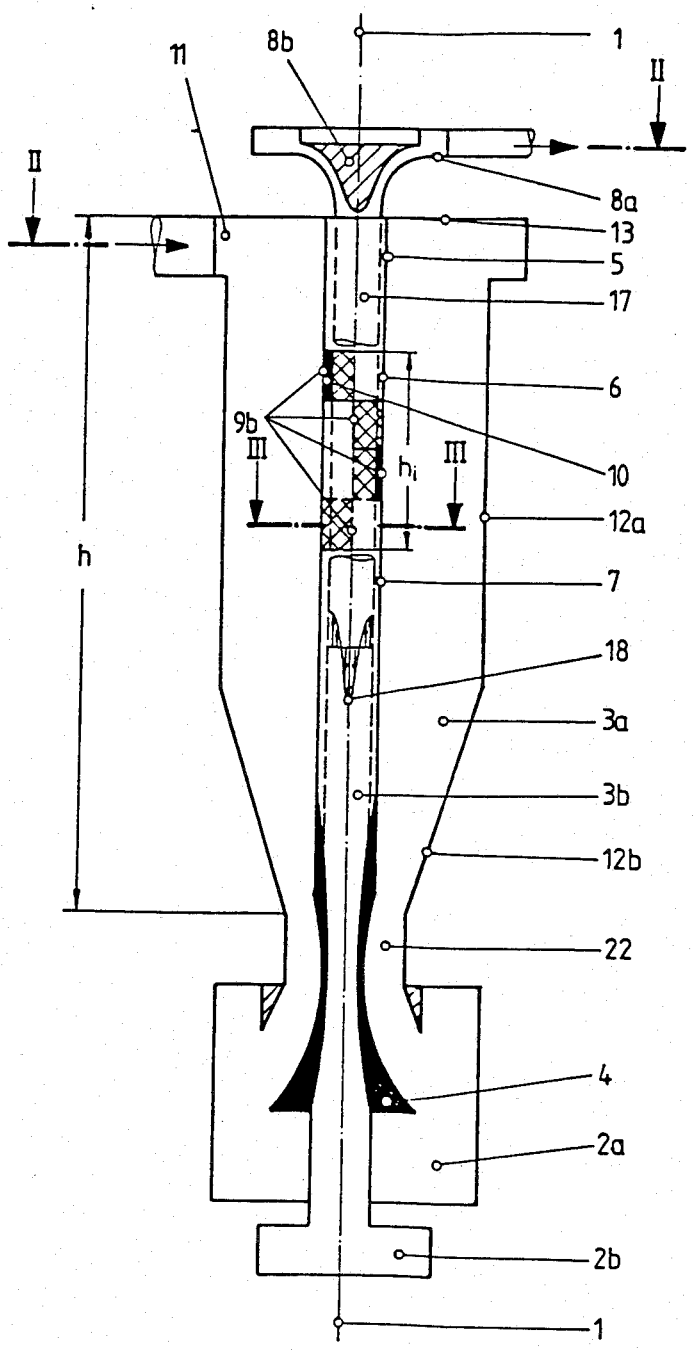

FIG. 3: A diagrammatic longitudinal section of a cyclone embodiment with the inventive immersion tube column, the slit immersion tube being provided with four helically displaced intake channels with in each case a straight leading edge.

Figure 4:
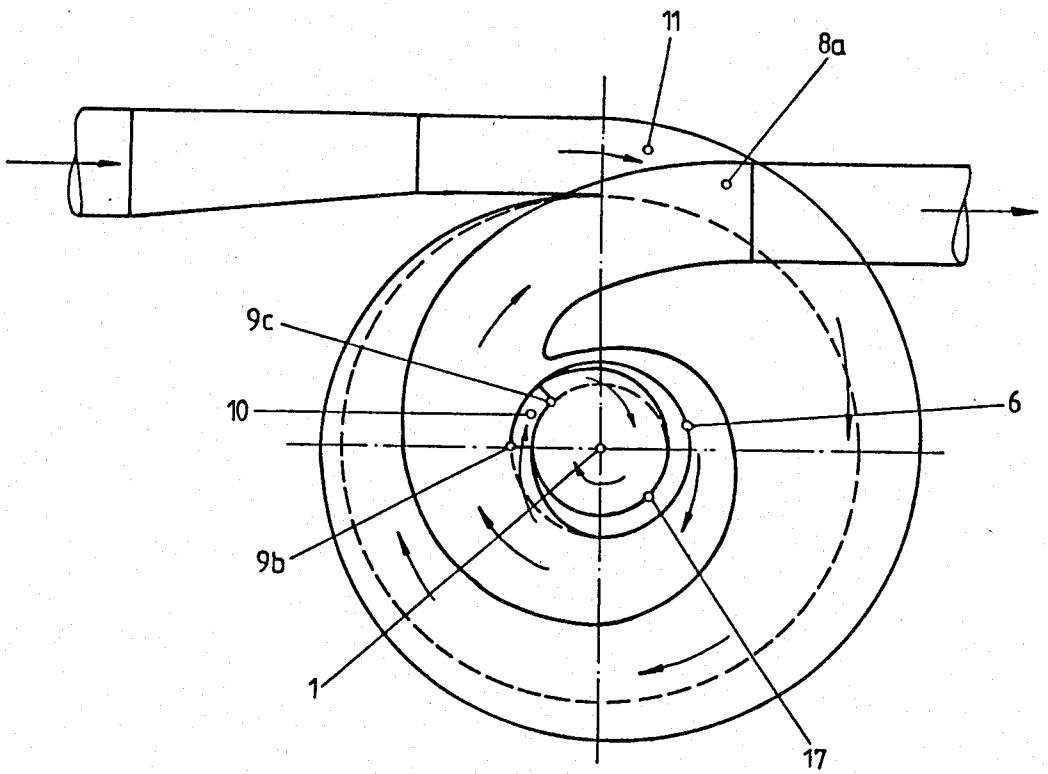

FIG. 4: A diagrammatic cross-section along section line II—II of FIG. 3.

Figure 5:
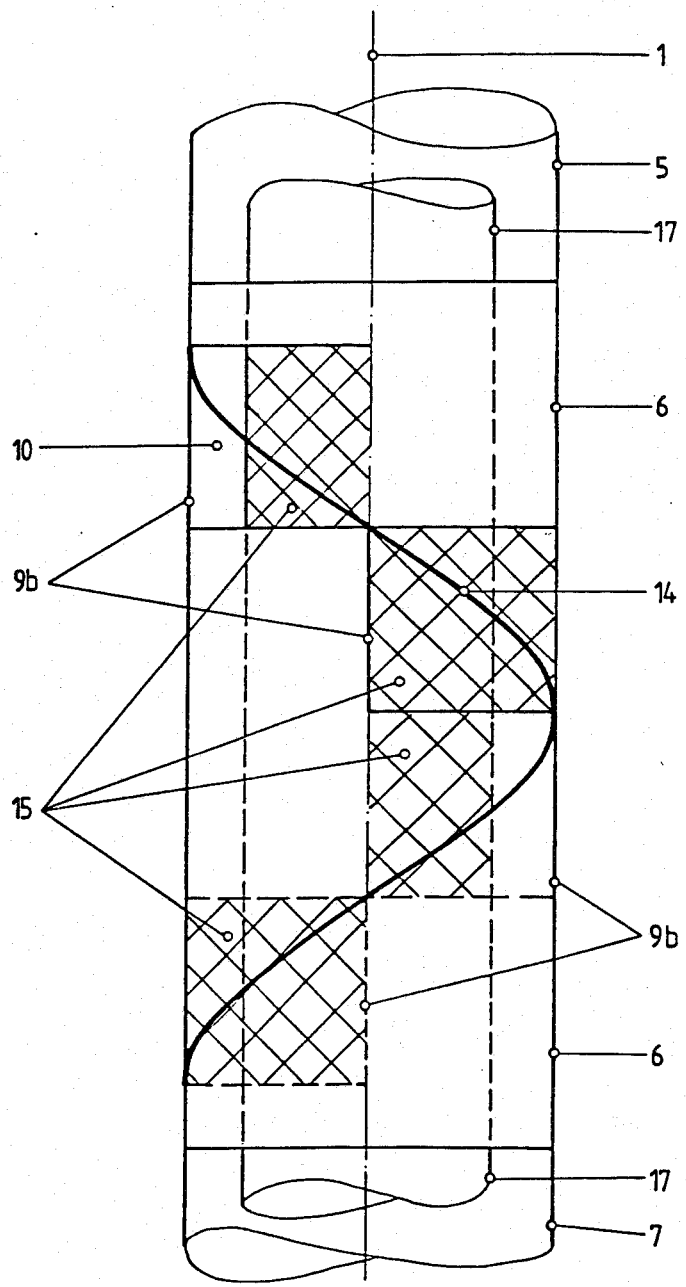

FIG. 5: A view of the inventive slit immersion tube with four helically reciprocally displaced intake channels with in each case a straight leading edge and a swirl promoter centred around the cyclone axis within the immersion tube column FIG. 6: A cross-section through the inventive slit immersion tube according to FIG. 5 along section line III—III of FIG. 3.

Figure 7:
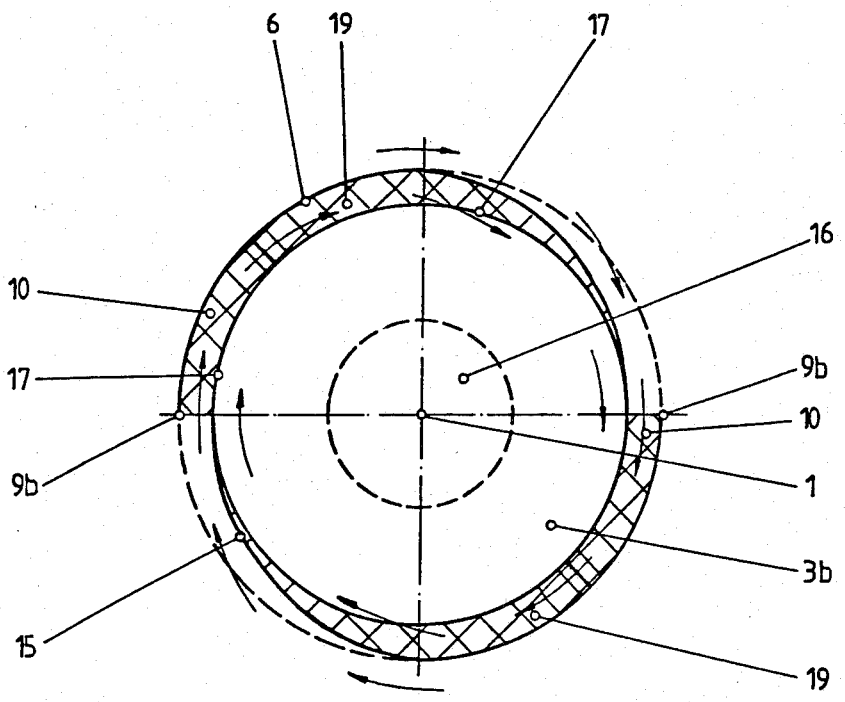

FIG. 7: A diagrammatic view of an inventive slit immersion tube with two parallel-wall slit channels symmetrically arranged at the same axial height and which are axially covered by upper and lower plates.

Figure 8:
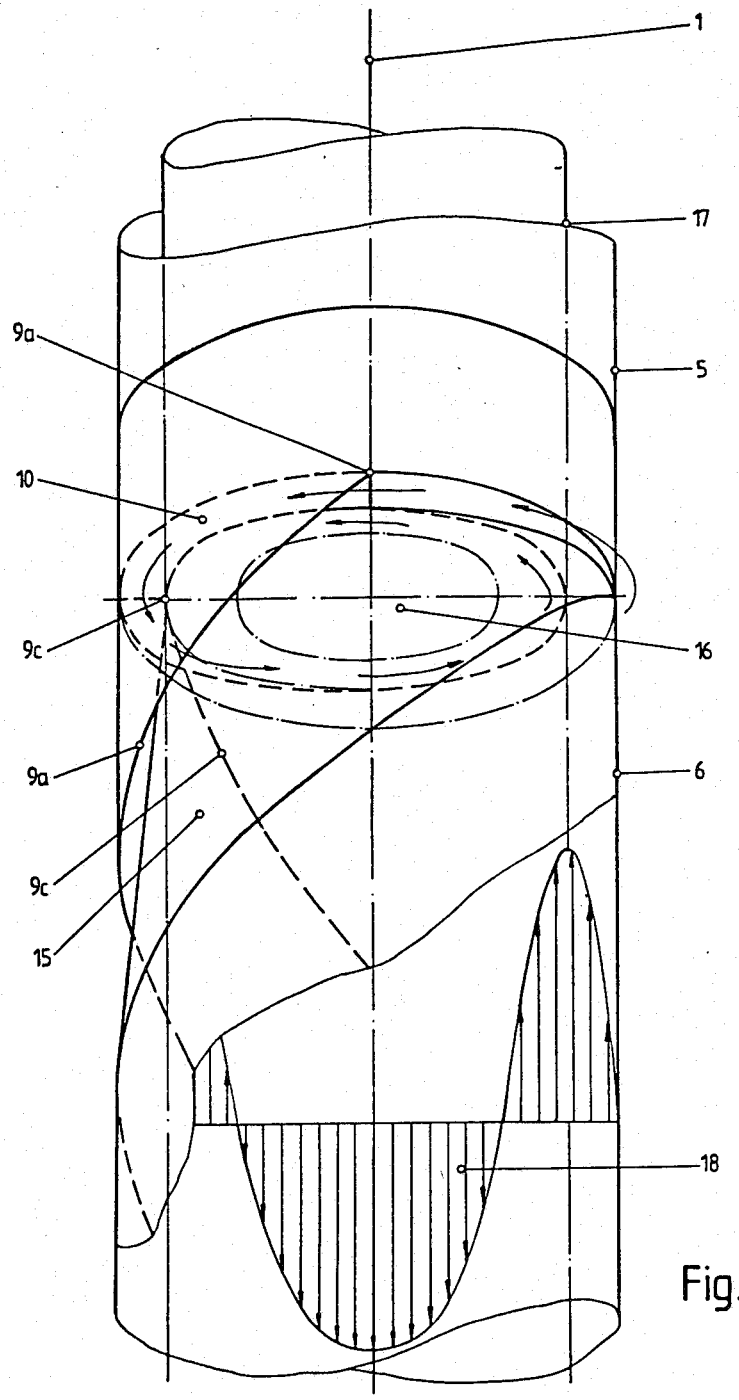

FIG. 8: A diagrammatic view of a slit immersion tube according to the invention with a helical, parallel-wall slit channel, which is constructed with a helical leading edge and helical trailing edge as a feed channel for the swirl promoter.

Figure 9:
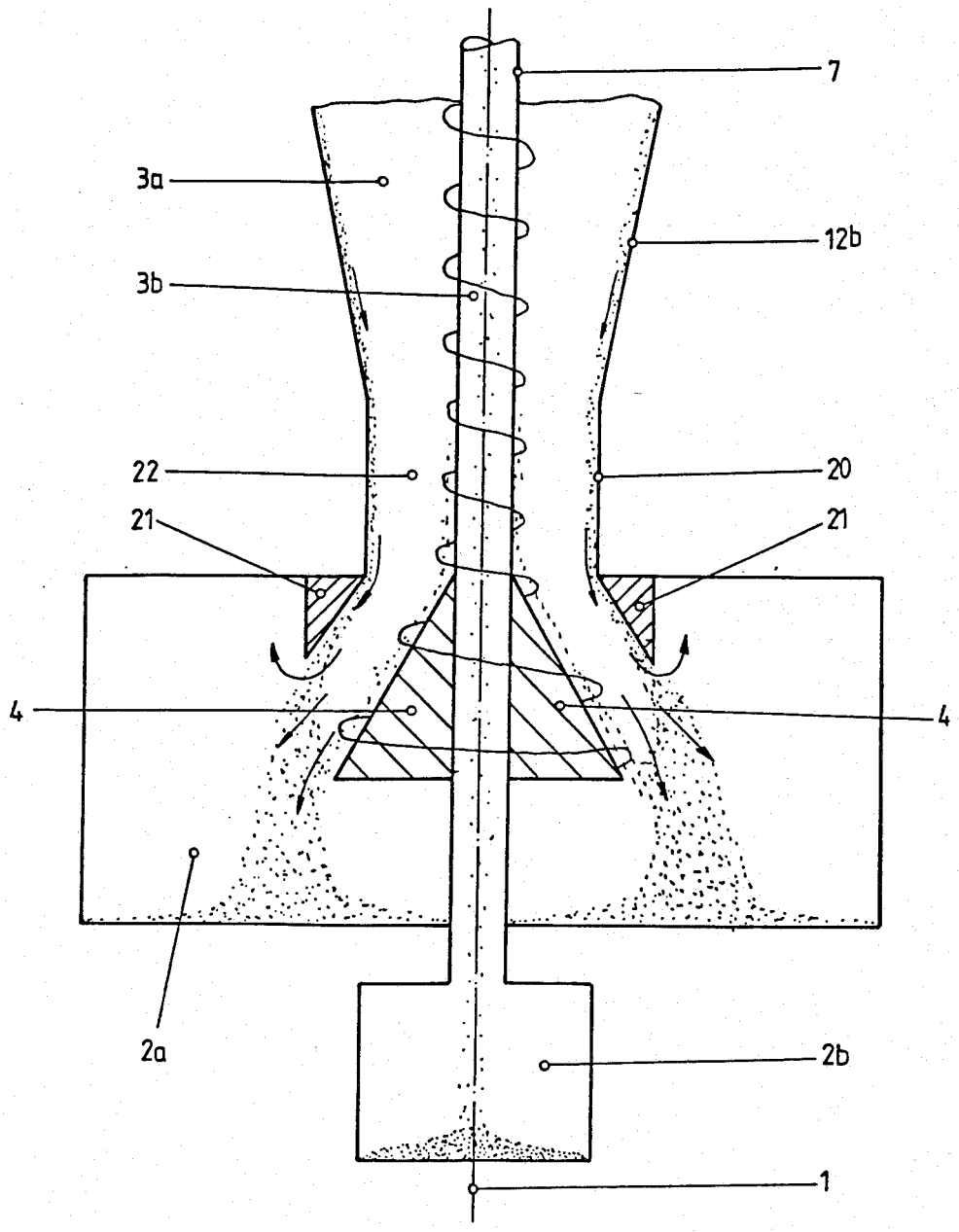

FIG. 9: The inventive two-stage solids discharge mechanism with shielding cone, which is arranged around the central immersion tube below the cylindrical shielding container.

Figure 10:
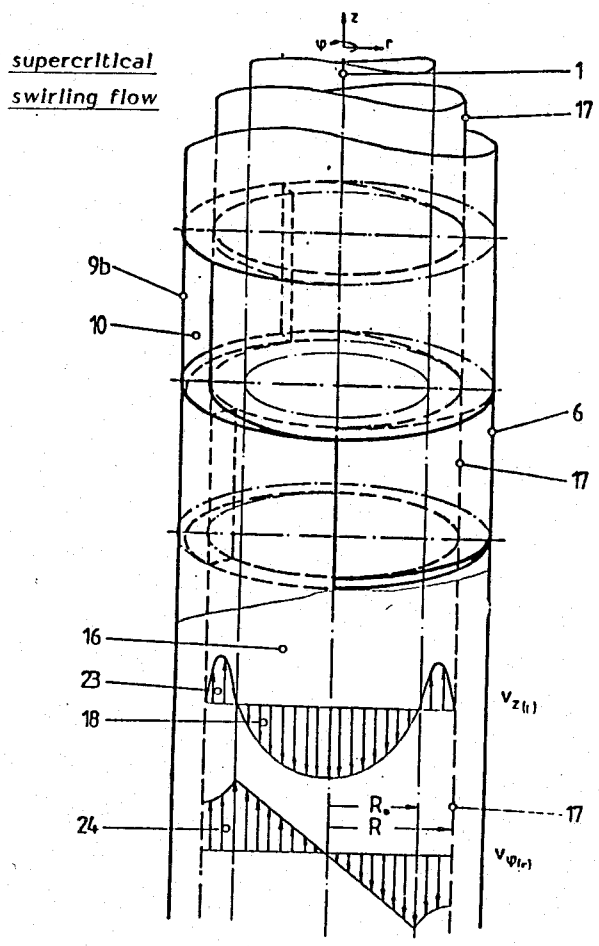
Figure 10:
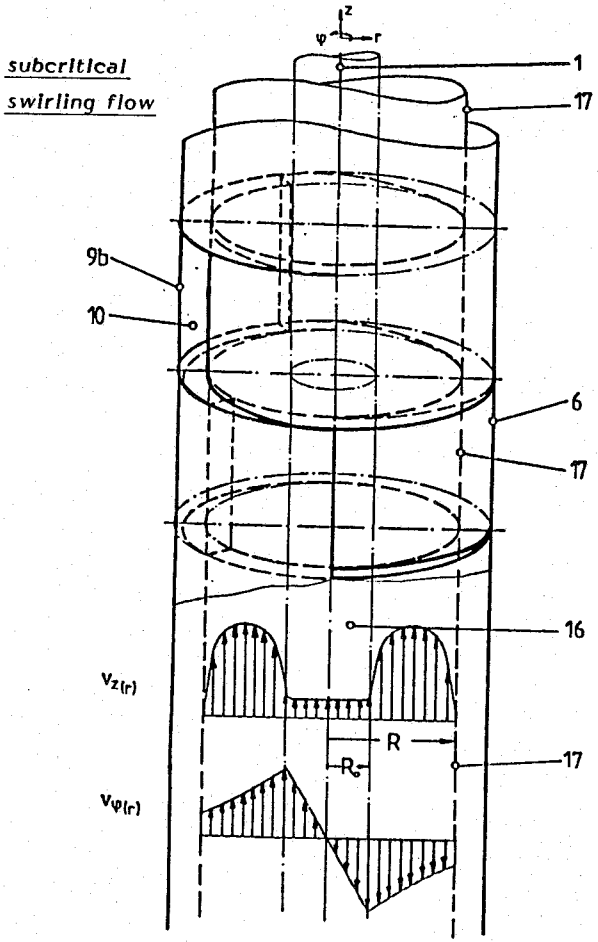

FIG. 10: A diagrammatic representation of the flow profiles with axial and tangential velocity $v_z$ and $v_{100}$, which form in the swirl promoter in the case of subcritical and supercritical swirling flow.

Figure 11:
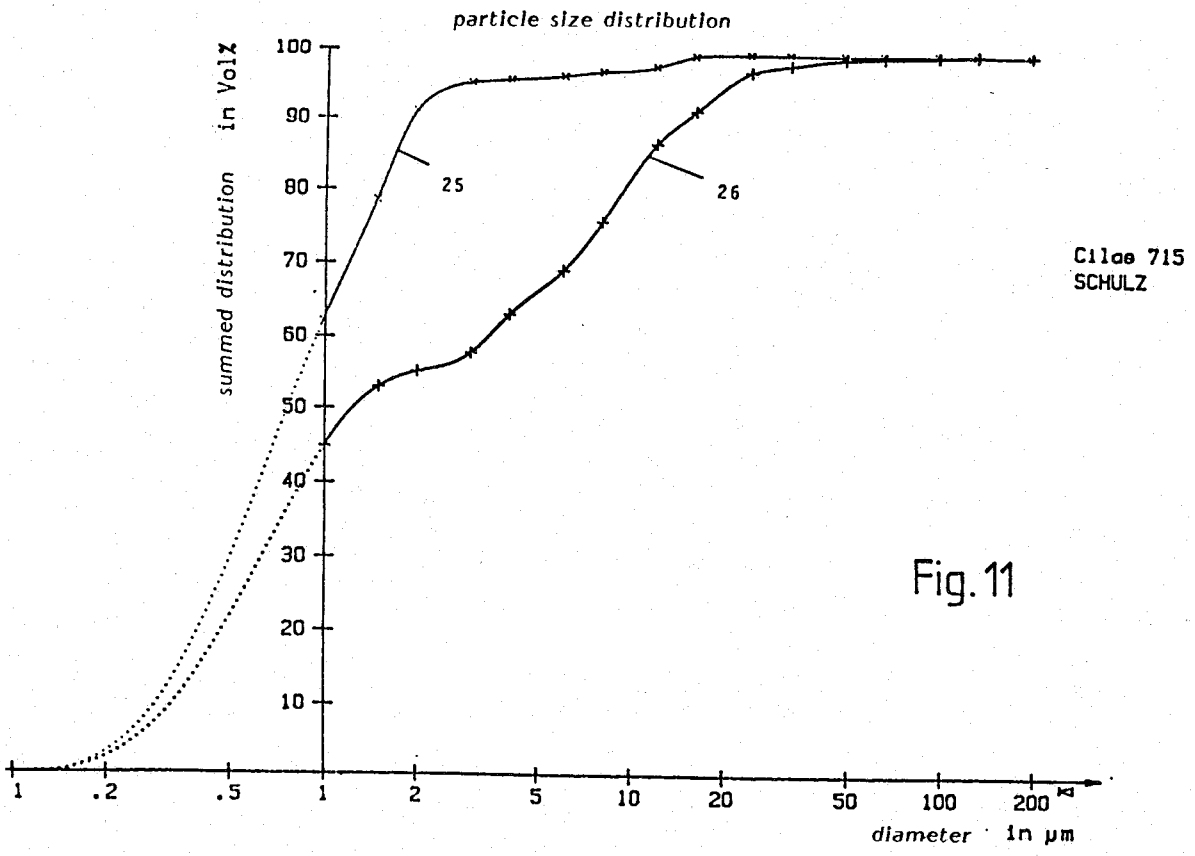

FIG. 11: Particle size distribution of the fines in the pure gas channel of the inventive cyclone separator (curve 25) compared with the particle size distribution of the fines in the purse gas channel of the same cyclone separator without the inventive immersion the tube column (curve 26).

The basic structure of the cyclone separator according to the invention with two separating zones and static guide mechanisms is constituted by a conventional cyclone. The four basic components shown in FIGS. 1 and 3, namely the cyclone casing 12*a*, 12*b*, the spiral intake channel 11, the cylindrical immersion tube 5 and the solids collecting chamber 2*a* are consequently also used as components of the cyclone separator according to the invention. In per se known manner, the cyclone casing comprises an upper cylindrical outer jacket 12*a* and an axially downwardly tapering bottom conical outer jacket 12*b*, the cylindrical casing being higher than the conical casing. Both jacket parts 12*a*, 12*b* surround the outer separating zone 3*a*. Into the cylindrical outer separating zone projects the cylindrical immersion tube 5 centred around the cyclone axis 1 and which is used for removing the dedusted two-phase flow (gas+fines). The tangential or spiral intake channel 11 serves to supply to the outer separating zone 3*a* the accelerated two-phase flow (gas+feed) entering the cyclone. The lower conical cyclone jacket 12*b* ends, according to FIG. 3 on a cylindrical shielding container 20 with an annular clearance-like outlet 22 for the separated coarse material, which is mounted in the conventional solids collecting container 2*a* below shielding container 20.

According to the inventive cyclone construction of FIGS. 1 and 3, the conventional immersion tube 5 is firstly axially extended by a slotted slit immersion tube 6, whose helical leading edge 9*a* (FIG. 1) or straight leading edges 9*b* (FIG. 3), extend over the suction height $h_i$. Although suction by means of a slotted slit immersion tube is known (DE-OS 32 23 374), the invention is constituted by the fact that the slit immersion tube 6 is open on its lower end face and has a slit channel 10, which is used as the intake channel for an immersion tube column, whose axis can be looked upon as the centre of the vortex core (cyclone eye). The arrangement of the bottom central immersion tube 7 in the axial extension of the slit immersion tube 6 leads to the complete immersion tube column 5, 6, 7 surrounding the complete separating zone height h and consequently can also be looked upon as a stabilizer for the outer swirling flow in the separating zone 3*a*. The production of an inner swirling flow and therefore a following separation in the inner separating zone 3*b* of the central immersion tube 7 (FIG. 4) or the swirl promoter 17 (FIG. 3) are permitted by several parallel-wall slit channels 10 uniformly distributed around the immersion tube circumference (FIGS. 3 and 4), a slit channel 10 constructed as a curved diffuser (FIG. 2) or a helical, parallel wall slit channel, each parallel-wall channel bringing about a flow-accelerating action and can produce a supercritical swirling flow. The outer swirling flow passes out on an outer portion of the central immersion tube 8 constructed as a shielding cone 4 and the inner swirling flow is centred about the swirl promoter axis. 1. The central immersion tube 7 passes through the conventional solids collecting container 2*a* and is connected to a second solids collecting container 2*b* below the first container 2*a* in a gas tight manner, so that no gas distribution is possible between the two containers.

In the cross-section of the inventive cyclone separator according to FIG. 1 shown in FIG. 2 a baffle 27 is provided below the tangential intake channel 11 in the plane parallel to cyclone cover 15, in such a way that an axially uniform inflow into the slit channel 10 without short-circuit flows is ensured. Baffle 27 passes from the centre angle $\phi=0°$, which is determined by the transition point of the outer wall of intake channel 11 tangentially entering the cylindrical outer jacket 12 of the cyclone casing, to the centre angle $\phi=180°$ as an annular collar around immersion tube 5. From there the leading edge of the baffle in the rotation direction of the swirling flow passes roughly tangentially to the outer circumference of the annular collar up to the inner wall of intake channel 11 on the underside thereof, whilst from there baffle 27 completely covers the annular cross-section between the immersion tube circumference and outer jacket 12 up to the centre angle $\phi=0°$ and terminates there in a radial edge running from the annular collar circumference to the outer jacket 12. The outer opening of the slit channel is located below the final portion of baffle 27. The annular collar formed by the baffle prevents particles from being transported in a wall-near solids flow (boundary layer flow) on cyclone cover 13 and along the outer circumferential surface of immersion tube 5 directly into the slit channel.

The cross-section of the inventive cyclone separator of FIG. 3 shown in FIG. 4 makes it possible to see the spiral inlet 11 of the cyclone and the spiral outlet casing 8*a* necessary for energy recovery purposes with a central, conical recess core 8*b*, the slit immersion tube 6 constituting an inflow guide mechanism for the outflow spiral 8. The flow arrows indicate the equidirectional flow guidance or distribution between the cyclone intake and the cyclone outlet.

FIG. 5 is a view of an inventive slit immersion tube 6 with four intake channels 10 reciprocally displaced along a helical line with in each case a straight, axial leading edge 9*b*, as well as a swirl promoter 17 centred about cyclone axis 1 within the immersion tube column 5, 6, 7. Recesses 15 (cf. also FIG. 6) in the slit immersion tube 6 are in each case reciprocally displaced by 90°.

Figure 6:
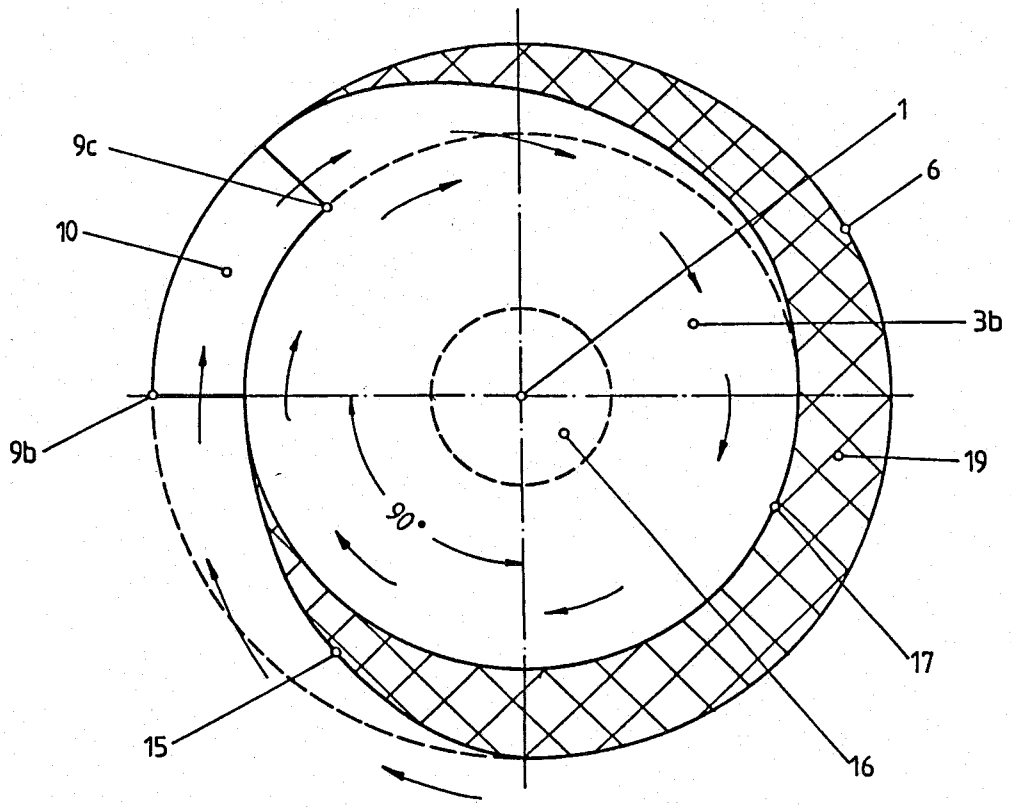

FIG. 6 shows the cross-section through the inventive slit immersion tube 6 according to FIG. 5 with parallel-wall outer and inner contours of the slit channel 10. The entry area into slit channel 10 and its outlet area in swirl promoter 17 are spiral. The inflow into swirl promoter 17 takes place exclusively by means of slit channel 10, so that any slit channel is provided with an upper and lower coverplate 19 for the ring cross-section between swirl promoter 17 and slit immersion tube 6.

If the slit immersion tube 6 is provided with two slit channels on the same axial height corresponding to FIG. 7 or with a helically rising leading edge 9*a* and trailing edge 9*c* according to FIG. 8, then cyclone axis 1 and swirl promoter axis are also identical, because there is a flow into swirl promoter 17 symmetrical to cyclone axis 1, so that in each construction of the slit immersion tube 6 a wake area 16 is formed due to the swirling flow and in it there are return flows 18.

FIG. 9 illustrates the inventive two-stage solid discharge device with a shielding cone 7, which is arranged around the central immersion tube 7 below the cylindrical shielding container 20, which is placed between the lower end of conical jacket 12*b* and the first solids collecting container 2*a*. The shielding cone 4 with a downwardly projecting base surface around the central immersion tube 7 is fixed to the latter and arranged within the primary solids collecting container 2*a*. A conical, downwardly widening deflecting shield 21 is arranged on the upper wall of container 4 following on to the cylindrical shielding container 20 and prevents solids which have already been separated from whirling up again. The second solids collecting container 2*b* is flanged in gas tight manner to central immersion tube 7 below the primary solids collecting container 2*a*.

FIG. 10 illustrates the different radial flow profiles of axial component $v_z$ and tangential component $v_{100}$ of the flow rate in swirl promoter 17 in the case of subcritical and supercritical swirling flow 23, 24, the return flow 18 in the case of supercritical swirling flow brings about the transfer of the particles concentrated in the wake area 16 in the second solids collecting container 2*b*.

FIG. 11 shows the improvement to the separating capacity obtained as a result of the particle size distributions of the fines in the clean gas channel of the inventive cyclone separator 25 compared with the conventional cyclone 26 without the immersion tube column 5, 6, 7 according to the invention.

The cyclone separator embodiment according to FIG. 3 operates with the following two-stage separating process.

The dust-containing gas sucked in by means of a compressor flows in per se known manner in the swirl-promoting intake channel 11 of the cyclone and via the latter into the cylindrical outer separating zone 3*a*, where the inflowing gas is uniformly sucked through the slit immersion tube 6 over the suction heights $h_i$ in the sense of the invention.

The flow in the cylindrical separating zone is a vortex sink. The gas flows on spiral paths with increasing velocity from the outside to the inside. The three-dimensional swirling flow produced makes it possible on the one hand to produce the tangential velocity component of the centrifugal acceleration required for separating purposes and on the other hand the axial velocity component transports the solids spirally along the outer cyclone jacket 12 into the primary solids collecting container 2*a*, because fine dust particles do not follow the flow lines of the gas because, under the action of the high centrifugal accelerations, they are passed out of the curved path against the cyclone jacket. The same secondary flows are observed on the separating zone wall as in a teacup. This secondary flow along the wall of the conical separating zone 12*b* is, however, useful, because it also covers the solids carried on the wall and leads same downwards to the solids collecting container 2*a*. There is a solids stream on the concave walls due to the disturbed equilibrium of the compressive and centrifugal forces.

The tangential and radial component of the vortex sink flow, whose velocity profile on the slit immersion tube 6 is constant over the height of the suction slit $h_i$, are sucked in between the outer and inner contours of the slit channel 10, so that the particles in the outer field of flow of cyclone 3*a* are forced to separate under constant conditions. As the dimensioning of the leading face of the slit immersion tube 6 takes place in such a way that the vortex sink flow in the outer separating zone 3*a* is not disturbed, there is a powerful vortex field around the immersion tube column 5, 6, 7, so that high centrifugal forces are made to act on the particles in the separating zone.

The gas flow sucked in via slit channel 10 from the primary separating zone 3*a* is then deflected on to the outer circumferential surface of the swirl promoter 17, in which is formed a second inner swirling field with the vortex core 16 of the cyclone, so that the secondary separating effect is initiated. According to FIG. 10 this inner swirling flow only has a two-dimensional field of flow, because there is no longer any radial velocity component (sink flow). As a result of the swirling flow within swirl promoter 17, ultra-fine particles stil suspended in the gas flow are "trapped" in the wake core 16 and are transported into the secondary solids collecting container 12 with the aid of the downwardly directed axial component 18. As a result of the central immersion tube 7 the particles have an adequate axial clearance, in order to arrive in areas where all the flow components have died away, but there are still strong tangential velocity components.

As in any curved flow, the static pressure drops in marked manner from the outside to the inside in the swirl promoter 17. The lowest pressure of the vortex prevails in the swirl promoter axis or cyclone axis 1. Thus, the compressive force acting on the particles is much higher than the centrifugal force, so that the strong secondary flows inwards towards cyclone axis 1 aid the secondary separating effect. The solids layers initially bound by the swirl promoter inner wall are displaced towards the radial pressure gradient, whilst the cleaned through flow 23 flows along the inner swirl promoter walls.

In the case of a powerful vortex, which is sought by a corresponding inventive immersion tube intake construction, the flow concentrates on a narrow outer annular zone in swirl promoter 17. The axial velocity component $v_z$ and the radius of the wake core $R_0$ become larger, of. FIG. 10. The swirl is no longer constant over radius r and velocity peaks 23, 24 form. According to FIG. 10, there is a reduction to the axial velocity $v_z$ in cyclone axis 1.

According to the laws of hydrodynamic equilibrium, in the case of a constant through flow, there is a physical dependence between the vacuum force, axial component $v_z$ and swirl intensity and this is only modified by the critical swirl. By increasing the latter a vacuum force minimum is compared with a kinetic energy minimum. This swirl increase allows the vacuum to increase to such an extent that there is a return flow 18 of the axial velocity within the vortex core 16. This phenomenon in which the swirling flow without an inner axial return flow in the wake core reverses into a swirling flow with an axial return flow 18 along the cyclone axis 1, is used for particle separation purposes within the swirl promoter 17. This sought flow reversal with maximum return flow is obtained in the case of high swirl and brings about the transporting away of the particles in the wake area 16, which are kept trapped as a result of the radial pressure drop in said area 16.

The different behavior of the flows with weak and strong swirl along cyclone axis 1, particularly within the slit immersion tube 6, can be attributed to the different pressure changes, which in the case of flows with a strong swirl bring about an internal return flow 18 from the slit immersion tube 6 to the following central immersion tube 7 or the secondary solids collecting container 2*b*. A slit immersion tube 6 bringing about this phenomenon of the return flows is fundamentally suitable for utilizing the secondary separating effect for dust separation from a flowing fluid.

Whereas the primary separating process in the outer separating zone 3*a* is based on the action of centrifugal forces on the particles, as in the conventional cyclone, for bringing about the secondary separating process within the swirl promoter use must be made of the flow reversal phenomenon for particle separation from a flowing fluid. This brings about a two-stage separation of particles suspended in two-phase flows in a single apparatus.

The kinetic energy of the swirling flow is recovered by an outflow spiral 8*a* with recess core dimensioned in known manner and arranged aboe the cyclone cover 13, so that both the axial component and the tangential component of the inner swirling flow are delayed in such a way that the cyclone entry velocity and cyclone exit velocity assume the same values for the same tube cross-sections of the raw gas and pure gas channel.

The effectiveness of the described two-stage separating process has been confirmed by numerous experiments on a cyclone test installation under near practical conditions. The reduction of the coarse-grain material proportion of the fines in the pure gas channel by incorporating inventive immersion tube column around the cyclone axis compared with a conventional cyclone construction without additional guide and separating mechanism is shown by FIG. 11 by means of comparative particle size analyses of the fines, the feed being constituted by quartz powder with an average particle size diameter of 6 μm. It can in particular be established that not only is there an increase in the overall separation efficiency and that the solids concentration in the pure gas channel decreases, but there is also a decisive improvement to the fraction separation efficiency, because the smallest particle size of 15 μm separated by 90% is displaced far into the finer particle size range of 2 μm.

Through the use of the invention the field of use of cyclone separators is greatly widened. A possible future use of the inventive cyclone is removing the dust from a pressure-operated fluidized bed firing system or furnace in a combined gas/steam turbine plant. The gas turbine planes are subject to both erosive and corrosive wear, so that the erosion action has a marked effect as from a particle diameter of $d \geqq 10$ μm. In addition, the air/flue gas-side pressure loss of the combined process considerably influences the process efficiency.

I claim:

1. Cyclone separator comprising two separating zones (3*a*, 3*b*) and static guide mechanisms for improving the separating capacity with respect to very finely dispersed particles from flowing gases and reducing the pressure drop or for influencing the field of flow of a centrifugal force separator with a tangential, spiral or helical intake channel (11), including an upper cylindrical (12*a*) and a lower conical (12*b*) cyclone casing, a solids collecting container (2*a*) located below it, whilst in the cylindrical separating zone, a cylindrical immersion tube (5) for removing the pure gas flow projects centrally from above into the cyclone casing, including an immersion tube column comprising a series connection of the immersion tube (5), a slotted slit immersion tube (6) with a helical or straight slit channel and a central immersion tube (7), by which the cyclone axis (1) is surrounded over the entire separating zone height h, is located in the cylindrical interface of the cyclone separator, passes through the solid collecting container (2*a*) and is connected in gas tight manner to a second solids collecting container (2*b*) located below the first container, means for enabling the three partial immersion tubes (5, 6, 7) to be connected in reciprocally open manner and the slit immersion tube (6) is the sole sucking partial immersion tube.

2. Cyclone separator according to claim 1, characterized in that between the intake channel (11) and the slit immersion tube (6) is provided a baffle (27) protecting the latter against short-circuit flows.

3. Cyclone separator according to claim 2, characterized in that the baffle (27) on the immersion tube (5) below the cyclone intake channel (11) is installed in the outer separating zone (3*a*) in the horizontal plane parallel to cyclone cover (13), so that short-circuit flows of the swirling flow are directly prevented in the suction channel (10) of the slit immersion tube (6) and the axial velocity component of the swirling flow is positively influenced with respect to the solids discharge behaviour in the outer separating zone (3*a*).

4. Cyclone separator according to one of the claims 1 to 3, characterized in that the sole sucking slit immersion tube (6) is constructed as a flow-favourable intake guide mechanism for an outlet spiral casing (8*a*) with recess core (8*b*) positioned above the cyclone cover (13).

5. Cyclone separator according to one of the claims 1 to 4, characterized in that the intake face of the parallel-wall slit channel (10) of the slit immersion tube (6) is constructed as a slotted opening within the slit immersion tube jacket in such a way that in the intake region of the slit channel the requisite flow velocity is set on the interface in accordance with the rotary sink flow present and is in turn capped by the configuration of the slit immersion tube circumference as a logarithmic spiral (15) in flow-favourable manner on the interface, so that the curved flow lines of the gas flow entering through the slit channel (10) into swirl promoter (17) pass along the outer and inner slit channel contour and in the same direction as the cyclone entry flow.

6. Cyclone separator according to claim 1, characterized in that the slit immersion tube (6) is provided with four parallel-wall intake channels (10) uniformly distributed around the immersion tube circumference and with in each case a straight leading edge (9), so that the common diagonal (14) of the four recess faces (15) displaced by 90° forms a single helical line about the slit immersion tube (6) as an intake channel with an accelerating flow action for a swirl promotor (17) symmetrical to cyclone axis (1), so that within the swirl promoter (17) a wake area (16) forms with axial return flows (18) into the central immersion tube (7) in the case of correspondingly high swirl intensity, being fixed by the geometrical design of the slit channel (10) and the slit immersion tube (6), high vacuum values on the cyclone axis (1) and strong pressure changes in the axial direction inducing the intense return flow (18) into central immersion tube (7) and subsequently into the secondary solids collecting container (2*b*).

7. Cyclone separator according to one of claims 1 and 6, characterized in that for increasing the rotational symmetry and swirl intensity the slit immersion tube (6) with four intake channels (10) helically distributed about the immersion tube circumference is replaced by a slit immersion tube provided either with several slit channels (10) uniformly distributed at the same axial height around the immersion tube circumference and in each case having a straight leading edge (9*b*) or with a parallel-wall, helical slit channel (10), which has a helical leading edge (9*a*) and a helical trailing edge (9*c*), so that a supercritical swirl intensity with return flows (18) into the central immersion tube (7) is produced if the particular slit channel (10) is constructed as a curved deflecting channel with an accelerating action and the particular slit channel (10) is provided with an upper and a lower coverplate (19), so that the suction from the outer separating zone (3*a*) takes place exclusively by means of a helical slit channel or by means of several slit channels uniformly distributed edgewise on the immersion tube circumference.

8. Cyclone separator according to one of the claims 1 to 7, characterized in that a cylindrical shielding container (20) is interposed between the conical part (12*b*) of the outer separating zone (3*a*) and the first solids collecting container (2*a*), so that the outer swirl flow ends on an outer portion of the central immersion tube (7) constructed as a shielding cone (4) within the first solids collecting container (2*a*), so that the separated solids can penetrate the first solids collecting container (2*a*) in troublefree manner and without entraining effects in the annular clearance 922) between the cylindrical shielding container (20) and the central immersion tube (7) and through the arrangement of a conical deflecting shield (21) below the cylindrical shielding container (20) and about the shielding cone (4) the solids cannot be whirled into the outer separating zone (3*a*) again

* * * * *